United States Patent [19]

DiTullio et al.

[11] 4,176,330

[45] Nov. 27, 1979

[54] DIPLEXER APPARATUS

[75] Inventors: Joseph G. DiTullio, Woburn; Leonard I. Parad, Framingham, both of Mass.; Donald J. Sommers, Brookline, N.H.

[73] Assignee: GTE Sylvania Incorporated, Stamford, Conn.

[21] Appl. No.: 863,808

[22] Filed: Dec. 23, 1977

[51] Int. Cl.[2] ..... H01P 1/16; H01P 1/20; H01P 5/20

[52] U.S. Cl. ..... 333/122; 333/21 A; 333/135

[58] Field of Search ..... 333/6, 9, 11, 21 A; 343/100 PE, 756, 786

[56] References Cited

U.S. PATENT DOCUMENTS

| | | | |
|---|---|---|---|
| 3,978,434 | 8/1976 | Morz et al. | 333/6 |
| 4,030,048 | 6/1977 | Foldes | 333/6 |
| 4,047,128 | 9/1977 | Mörz | 333/21 A X |
| 4,100,514 | 7/1978 | DiTullio et al. | 333/21 A X |

*Primary Examiner*—Paul L. Gensler
*Attorney, Agent, or Firm*—Peter Xiarhos

[57] ABSTRACT

A microwave diplexer apparatus for handling simultaneously two independent polarized transmitted signals at one frequency and two independent polarized received signals at a lower frequency. In the transmit mode of operation, a pair of input signals are applied to a first orthogonal mode transducer wherein the electric fields of the signals are established at right angles to each other. The orthogonal, linearly-polarizer signals are then transformed by a pin/ridge-loaded circular polarizer device to oppositely-rotating circularly-polarized signals and coupled via an antenna port of a second orthogonal mode transducer to an antenna for transmission to a desired target.

In the receive mode of operation, a pair of independent oppositely-rotating circularly-polarized signals from the target are received and coupled via the antenna port of the second orthogonal mode transducer to other ports of the second orthogonal mode transducer to which two pairs of arms are coupled for the passage therethrough of orthogonal vectoral components of the circularly-polarized signals. The two pairs of arms are coupled to corresponding magic tee hybrid devices wherein the orthogonal vectoral components derived from the circularly-polarized signals in the pairs of arms are combined and applied to corresponding pin-loaded polarizer devices wherein a phase shift differential of 90° is introduced to the vectoral components in the pairs of arms. The vectoral components from the polarizer devices are applied to another magic tee hybrid device wherein a pair of resultant signals corresponding to the two circularly-polarized signals are derived.

12 Claims, 8 Drawing Figures

DIPLEXER APPARATUS

CROSS-REFERENCE TO RELATED APPLICATIONS

In co-pending patent application Ser. No. 791,969, now U.S. Pat. No. 4,100,514, filed Apr. 28, 1977 in the names of Joseph G. DiTullio and Leonard I. Parad, and entitled "Broadband Microwave Polarizer Device", there is disclosed and claimed a broadband microwave polarizer device which may be employed in the present invention.

In co-pending patent application, Ser. No. 863,807, filed concurrently with the present application in the names of Joseph G. DiTullio and Leonard I. Parad, and entitled "Diplexer Apparatus", there is disclosed and claimed a diplexer apparatus representing a variation of the diplexer apparatus disclosed in the present application.

BACKGROUND OF THE INVENTION

The present invention relates to a microwave diplexer apparatus and, more particularly, to a microwave diplexer apparatus capable of handling simultaneously two transmitted signals and two received signals in conjunction with a single antenna.

Diplexer apparatus capable of handling simultaneously pairs of transmitted and received signals associated with a single antenna are well known to those skilled in the art. By way of example, diplexer apparatus capable of the above type of operation is disclosed in U.S. Pat. No. 3,731,235, issued May 1, 1973 in the names of Joseph G. DiTullio, Leonard I. Parad and Kenneth E. Story, and also in U.S. Pat. No. 3,731,236, issued May 1, 1973 in the names of Joseph G. DiTullio, Donald J. Sommers and Windsor D. Wright, both of the above patents being assigned to the same assignee as the present application. While the apparatus as described in the abovementioned patents is satisfactory in many communication systems, the apparatus has been used heretofore for the handling of linearly-polarized signals as opposed to circularly-polarized signals.

SUMMARY OF THE INVENTION

In accordance with the present invention a diplexer apparatus is provided which may be employed for handling circularly-polarized signals. The diplexer apparatus in accordance with the invention includes a first transducer means having first and second input ports and an output port. The first transducer means is operative to receive first and second signals within a first frequency bandwidth at the first and second input ports, respectively, and to establish said signals at the output port thereof to be orthogonal and linearly-polarized with respect to each other.

A first polarizer means is coupled to the first transducer means and operates to transform the orthogonal linearly-polarized signals at the output port of the first transducer means to orthogonal circularly-polarized signals. An electromagnetic wave conducting means having a first port and a second port is coupled via the first port to the first polarizer means and operates to pass the circularly-polarized signals from the first polarizer means to the second port thereof. The electromagnetic wave conducting means further has third, fourth, fifth and sixth ports and is further operative to receive first and second circularly-polarized signals within a second frequency bandwidth at the second port thereof and to couple orthogonal vectoral components of said circularly-polarized signals to the third, fourth, fifth and sixth ports thereof. Four sections of waveguide are coupled to the third, fourth, fifth and sixth ports of the electromagnetic wave conducting means with first and second ones of the sections of waveguide being operative to pass therethrough vectoral components of the circularly-polarized signals at the third and fifth ports of the electromagnetic wave conducting means and third and fourth ones of the sections of waveguide being operative to pass therethrough orthogonal vectoral components of the circularly-polarized signals at the fourth and sixth ports of the electromagnetic wave conducting means.

A first combining means having first and second inputs coupled respectively to the first and third sections of waveguide operates to combine at an output thereof the vectoral components in the first and third sections of waveguide derived from the first and second circularly-polarized signals. Similarly, a second combining means having first and second inputs coupled respectively to the second and fourth sections of waveguide operates to combine at an output thereof the vectoral components in the second and fourth sections of waveguide derived from the first and second circularly-polarized signals. Second and third polarizer means are coupled respectively to the outputs of the first and second combining means and operate to introduce a predetermined phase shift differential between the vectoral components at the outputs of the first and second combining means. A third combining means having first and second inputs coupled to the second and third polarizer means, respectively, operates in response to the vectoral components from the second and third polarizer means to establish at first and second outputs thereof first and second, resultant, orthogonal linearly-polarized signals each corresponding to a different one of the circularly-polarized signals.

BRIEF DESCRIPTION OF THE DRAWING

Various objects, features and advantages of a microwave diplexer apparatus in accordance with the present invention will be apparent from the following detailed discussion taken in conjunction with the accompanying drawing in which.

DETAILED DESCRIPTION OF THE INVENTION

Figure 2:
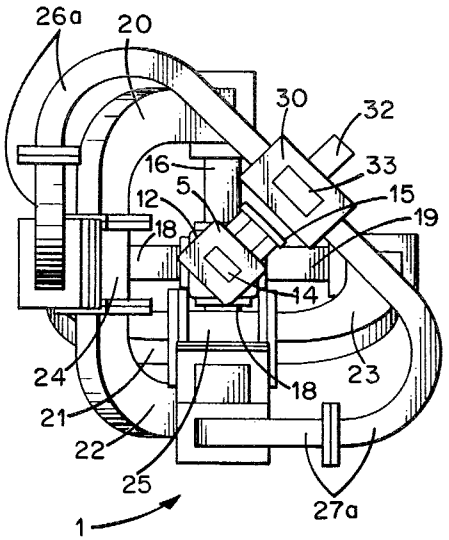
FIGS. 1-3 are top, end and front views, respectively, of a microwave diplexer apparatus in accordance with the present invention.
Figure 1:
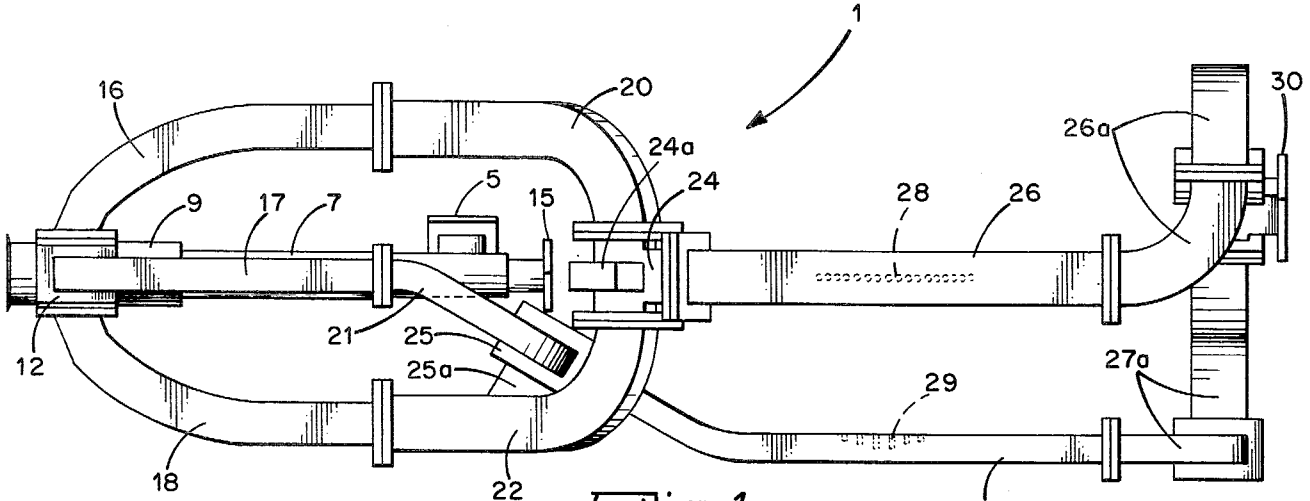
Figure 3:
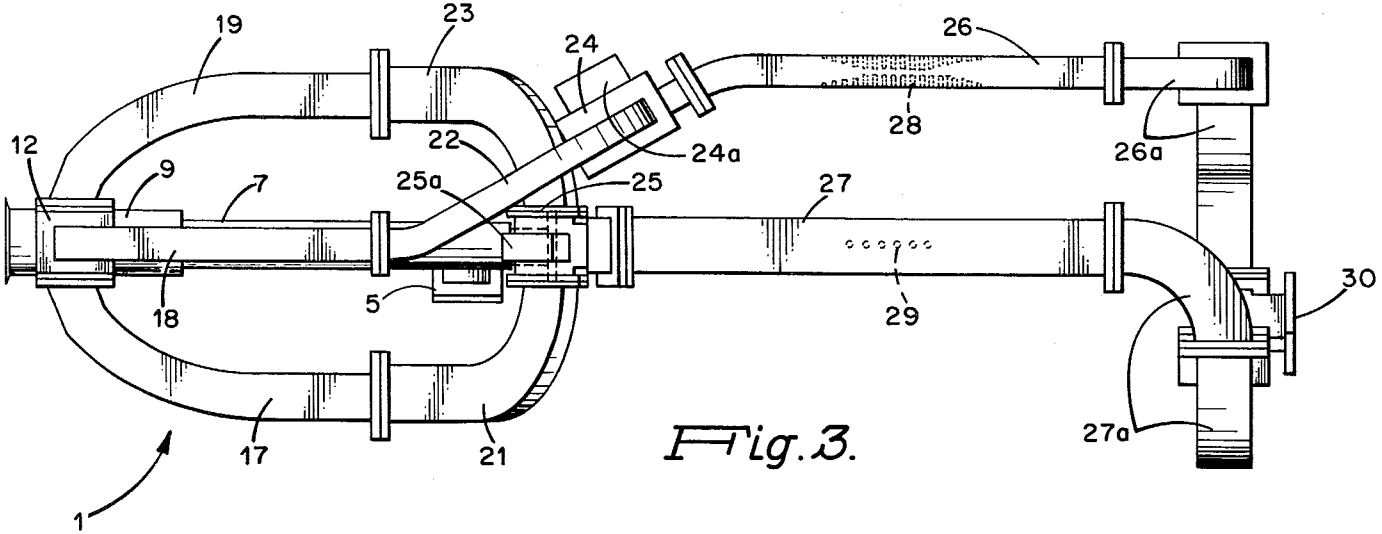

Referring now to FIGS. 1-3, there is shown a microwave diplexer apparatus 1 in accordance with the present invention. The diplexer apparatus 1 as shown in FIGS. 1-3 is employed for processing a pair of independent input signals for transmission to a target, specifically, in a circularly-polarized form, and for processing a pair of independent circularly-polarized signals as received from the target into individual linearly-polarized signals for use by receiver apparatus employed in conjunction with the diplexer apparatus 1. In the usual operation of the diplexer apparatus 1, the transmitted signals are of a first frequency within a first frequency bandwidth, for example, a bandwidth of 5.925 Ghz–6.425 Ghz, and the received signals are of a second, lower frequency within a second frequency bandwidth, for example, a bandwidth of 3.7 Ghz–4.2 Ghz. The transmission and reception of signals is accomplished by the use of a single antenna and the processing of the transmitted and received signals as mentioned hereinabove may be accomplished in a simultaneous, mutually-exclusive fashion. As is well understood, the diplexer apparatus 1 operates on the principle of reciprocity and the transmit and receive functions may be reversed without necessitating changes in the diplexer apparatus itself.

The transmission of signals in a circularly-polarized form to a target is accomplished by the diplexer apparatus 1 by utilizing a series arrangement of components including a first orthogonal mode transducer 5, a circular polarizer device 7, an impedance-matching transformer device 9, and a second orthogonal mode transducer 12. An antenna (not shown) is arranged to be coupled to the second orthogonal mode transducer 12 by means of a suitable adapter (also not shown) so that signals from the diplexer apparatus 1 may be appropriately directed by the antenna toward a target during the transmit mode.

A pair of signals to be processed into a circularly-polarized form for transmission to a target by the antenna are applied to two separate sections of rectangular waveguide 14 and 15 (FIG. 2) of the orthogonal mode transducer 5. These signals are of the same (higher) frequency within the transmit frequency bandwidth (5.925 Ghz–6.425 Ghz) and are conducted into the circular waveguide section of the orthogonal mode transducer 5. As is well understood, due to the symmetry of the circular waveguide section of the orthogonal mode transducer 5 and the orthogonal orientation and propagation properties of the rectangular waveguide sections 14 and 15 of the orthogonal mode transducer 5, the electric fields of the signals applied to the rectangular waveguide sections 14 and 15 are established, or polarized, within the orthogonal mode transducer 5 to be at right angles to each other and also to the planes of the broad walls of the respective sections of waveguide 14 and 15. The orthogonal linearly-polarized signals so established within the orthogonal mode transducer 5 are coupled into the circular polarizer device 7. The linearly-polarized signals are converted, or transformed, within the circular polarizer device 7 to oppositely-rotating, circularly-polarized signals.

Figure 4:
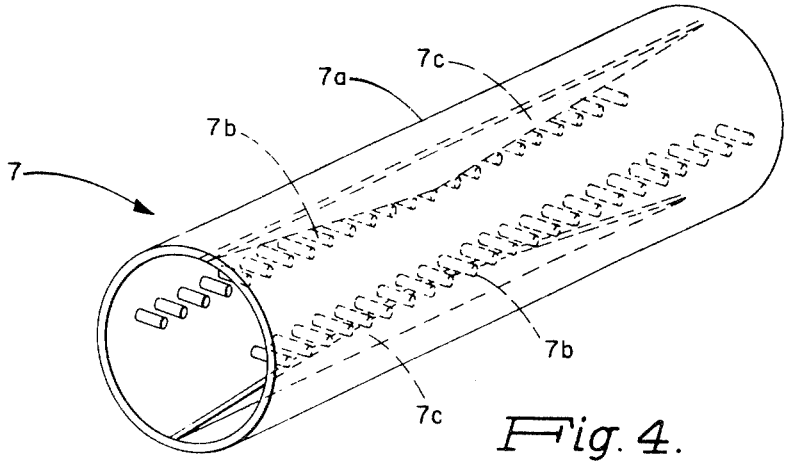
FIG. 4 is an enlarged perspective view of a circular waveguide broadband polarizer device which may be employed in the diplexer apparatus of FIG. 1.
Figure 5:
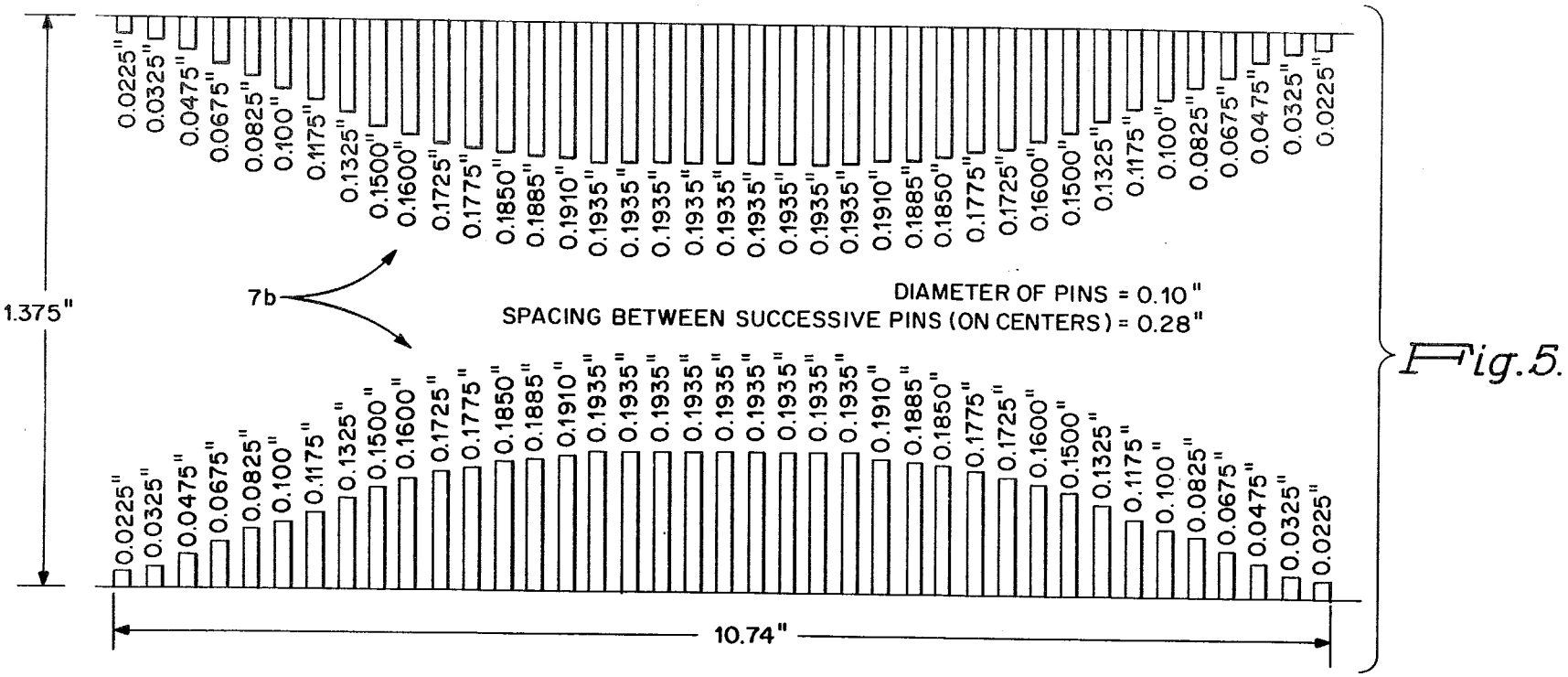
FIGS. 5 and 6 are enlarged cross-sectional views illustrating internal details of the polarizer device of FIG. 4.
Figure 6:
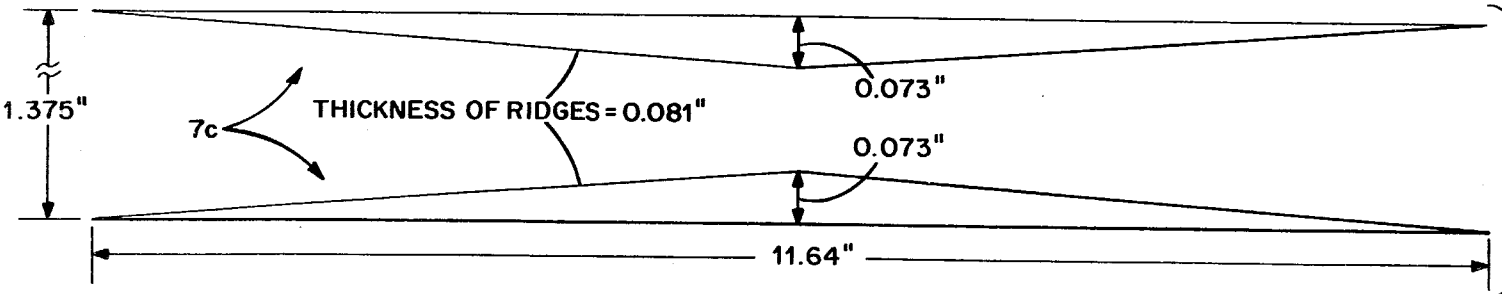

A particularly suitable implementation of the polarizer device 7 is shown in FIG. 4 and includes a circular section of waveguide *7a* having two opposing rows of spaced pins *7b* in a first common plane, and two opposing ridges *7c* in a second common plane transverse to the first plane. By appropriate design of the circular polarizer device 7, the rows of pins *7b* and the pair of ridges *7c* may be made to provide 120° and 30° phase shift contributions, respectively, with the resultant phase shift or differential being equal to 120° minus 30°, or 90°. The particular advantage of the above type of circular polarizer device 7 is that the resultant phase shift between the circularly-polarized signals is relatively constant over the entire frequency bandwidth of the transmitted signals (5.925 Ghz–6.425 Ghz), varying by only ±0.8° over the entire frequency bandwidth. Suitable dimensions for the pins and ridges by which this result can be achieved are set forth in FIGS. 5 and 6. For optimum operation of the diplexer apparatus 1, the polarizer device 7 is physically positioned with respect to the orthogonal mode transducer 5 so that the plane of either the rows of pins *7b* or the ridges *7c* of the polarizer device 7 is at an acute angle of 45° with respect to the plane of the broad wall of either of the rectangular waveguide sections of the orthogonal mode transducer 5. The circular polarizer device 7 as described hereinabove is also described and claimed in the aforementioned U.S. Pat. No. 4,100,514. For further details of the polarizer device 7, reference may be made to the aforementioned patent.

The circularly-polarized signals produced at the output of the circular polarizer device 7 as described above are coupled through the impedance-matching transformer device 9 to a first port at one end of the second orthogonal mode transducer 12. The transformer device 9 serves, in known fashion, to match the impedance between the transducer 12 and the elements 5 and 7. The circularly-polarized signals coupled into the orthogonal mode transducer 12 are applied to a second, antenna port of the orthogonal mode transducer 12 and coupled via a suitable adapter (not shown) to the antenna for transmission to the desired target. It is further to be noted that while the orthogonal mode transducer 12 has other ports as most clearly indicated in FIGS. 1 and 3, these ports being coupled to receive portions of the diplexer apparatus 1, the transmitted circularly-polarized signals coupled to the antenna are prevented from being applied to and interfering with the receive portions of the diplexer apparatus 1 by means of a plurality of low-pass filters 16–19 coupled with these other ports. The low-pass filters 16–19, to be discussed more fully hereinafter, are constructed so as to act as short circuits to the frequency of the transmitted signals so that the signals do not pass into the receive portions of the diplexer apparatus 1. The filters 16–19 further act as matched impedances to signals of the second, lower frequency received from the antenna, as will also be discussed hereinafter. The diameter of the circular waveguide section of the orthogonal mode transducer 12 is such as to pass both the higher frequency transmitted signals and the lower frequency received signals. The smaller diameters of the circular polarizer device 7 and the circular waveguide section of the orthogonal mode transducer 5 are such as to pass only the higher frequency transmitted signals and cut off the lower frequency received signals.

In the receive mode of operation of the diplexer apparatus 1, a pair of oppositely-rotating circularly-polarized signals of the lower frequency as received from the target and applied to the antenna are coupled into the antenna port of the orthogonal mode transducer 12. These signals, which may be designated as right-hand and left-hand circularly-polarized signals, are coupled from the orthogonal mode transducer 12 into four rectangular receive openings located at orthogonal positions in the circular waveguide section of the orthogonal mode transducer 12. The signals are coupled via the receive openings into the aforementioned low-pass filters 16–19 and four associated rectangular sections of waveguide 20–23 connected with the filters 16–19. One vectoral component of each of the circularly-polarized signals dividers into two parts which are respectively coupled via the filters 16 and 18 into the sections of waveguide 20 and 22 and the other vectoral component of the signal similarly divides into two parts which are respectively coupled via the filters 17 and 19 into the sections of waveguide 21 and 23.

The vectoral components passing through the sections of waveguide 20 and 22 are coupled to first and second input ports of a first magic tee hybrid device 24 and, similarly, the vectoral components passing through the sections of waveguide 21 and 23 are coupled to first and second input ports of a second magic tee hybrid device 25. The magic tee hybrid device 24 operates to combine at an output port (sum port) thereof vectoral components (e.g. vertical vectoral components) derived from both of the circularly-polarized signals, and, similarly, the magic tee hybrid device 25 operates to combine at an output port (sum port) thereof second vectoral components (e.g. horizontal vectoral components) derived from both of the circularly-polarized signals. By way of specific example, the sections of waveguide 20 and 22 may conduct pairs of vertical vectoral components $\overrightarrow{LV1}$, $\overrightarrow{RV1}$ and $\overrightarrow{LV2}$, $\overrightarrow{RV2}$, respectively, derived from the left-hand and right-hand circularly-polarized signals and, similarly, the sections of waveguide 21 and 23 may conduct pairs of horizontal vectoral components $\overrightarrow{LH1}$, $\overrightarrow{RH1}$ and $\overrightarrow{LH2}$, $\overrightarrow{RH2}$, respectively, derived from the left-hand and right-hand circularly-polarized signals. The output of the magic tee hybrid device 24 represents a vectoral summation of the left-hand and right-hand vertical components, that is, $\overrightarrow{LV}=\overrightarrow{LV1}+\overrightarrow{LV2}$ and $\overrightarrow{RV}=\overrightarrow{RV1}+\overrightarrow{RV2}$, and, similarly, the output of the magic tee hybrid device 25 represents a vectoral summation of th left-hand and right-hand horizontal components, that is, $\overrightarrow{LH}=\overrightarrow{LH1}+\overrightarrow{LH2}$ and $\overrightarrow{RH}=\overrightarrow{RH1}+\overrightarrow{RH2}$. The pairs of vectoral components $\overrightarrow{LV}$, $\overrightarrow{RV}$ and $\overrightarrow{LH}$, $\overrightarrow{RH}$ at the outputs of the magic tee hybrid devices 24 and 25 are, thus, orthogonal to each other and linearly-polarized. To minimize resonances in the system due to factors such as minor variations in dimensions of the component parts of the diplexer apparatus, a pair of additional ports 24*a* and 25*a* (FIG. 3) of the magic tee devices 24 and 25, normally referred to as the difference ports, are terminated in a known fashion in dummy loads (e.g. resistive loads).

Figure 7:
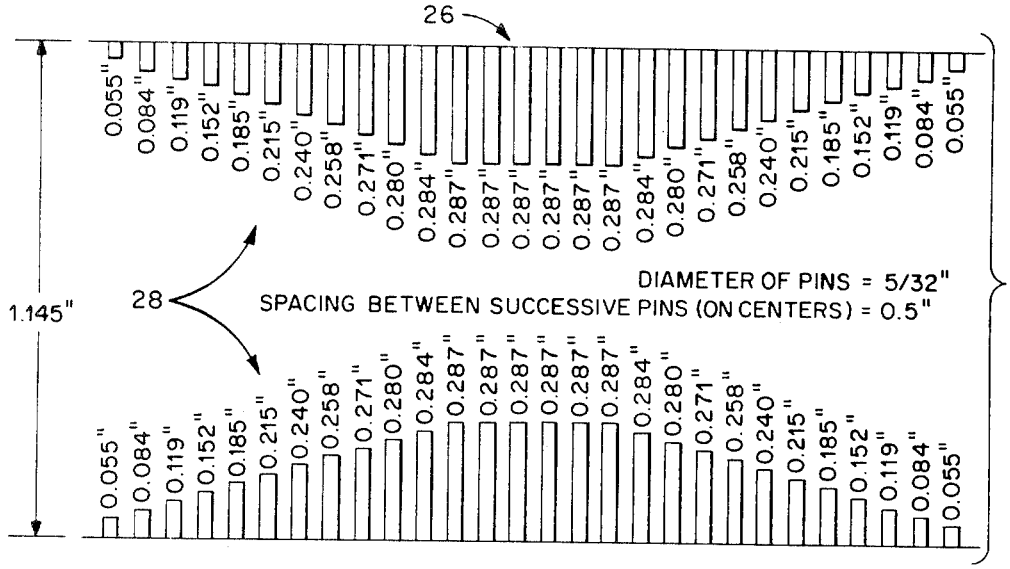
FIGS. 7 and 8 are enlarged cross-sectional views illustrating internal details of rectangular waveguide polarizer members employed in the diplexer apparatus of FIG. 1.
Figure 8:
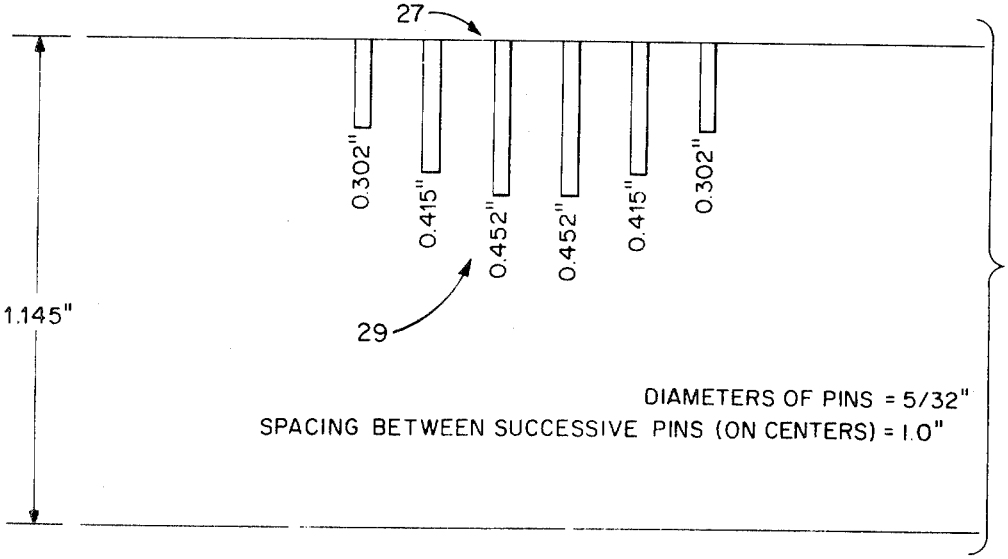

The orthogonal linearly-polarized vectoral components $\overrightarrow{LV}$, $\overrightarrow{RV}$ and $\overrightarrow{LH}$, $\overrightarrow{RH}$ at the output ports of the magic tee hybrid devices 24 and 25 are coupled to respective sections of rectangular waveguide 26 and 27. The section of waveguide 26 is constructed in accordance with the present invention to have opposing rows of spaced pins 28 therein, as shown in FIG. 7, for introducing a phase shift contribution to the vectoral components $\overrightarrow{LV}$, $\overrightarrow{RV}$ applied to that section, for example, a 120° phase shift contribution, and, similarly, the section of waveguide 27 is constructed to have a single row of pins 29 therein, as shown in FIG. 8, for introducing a phase shift contribution to the vectoral components $\overrightarrow{LH}$, $\overrightarrow{RH}$ applied to that section, for example, a 30° phase shift contribution. The 120° and 30° phase shift contributions result in the vectoral components $\overrightarrow{LV}$, $\overrightarrow{RV}$ and $\overrightarrow{LH}$, $\overrightarrow{RH}$ at the outputs of the sections of waveguide 26 and 27 having a phase displacement or differential with respect to each other of 120° minus 30°, or 90°. By loading the sections of waveguide 26 and 27 with pins as described above, the sections of waveguide 26 and 27 accordingly act as polarizer devices, in the manner of the aforedescribed polarizer device 7, and convert or transform vectoral components of circularly-polarized signals coupled into the second orthogonal mode transducer 12 into vectoral components of linearly-polarized signals at the outputs of the sections of waveguide 26 and 27.

The orthogonal, linearly-polarized signals at the outputs of the sections of waveguide 26 and 27 are applied via sections of rectangular waveguide 26*a* and 27*a* to first and second inputs of a third magic tee hybrid device 30. The magic tee hybrid device 30 operates to derive first and second resultant, orthogonal, linearly-polarized signals from the vectoral components at the outputs of the sections of waveguides, represented vectorally by $\overrightarrow{L}=\overrightarrow{LV}+\overrightarrow{LH}$ and $\overrightarrow{R}=\overrightarrow{RV}+\overrightarrow{RH}$ and corresponding, respectively, to the left-hand and right-hand circularly-polarized signals, and to apply the resultant signals separately to a pair of output ports 32 and 33 (FIG. 2). These signals may then be used by receiver apparatus (not shown) connected to the output ports.

In the design of the abovedescribed diplexer apparatus 1, it is important that the electrical path lengths between ports of the orthogonal mode transducer 12 and ports of the third magic tee device 30 be the same. This result can best be achieved in a practical construction by appropriately forming and dimensioning the various parts of the diplexer apparatus 1 so that the physical path lengths between the ports of the transducer 12 and the ports of the magic tee device 30 are the same. As a practical matter, due to the relative positioning of the various parts of the diplexer apparatus 1, this may necessitate that some parts be longer than others and have bends or curves at different places but, for best results, the different physical paths should have the same numbers and types of bends and the same overall lengths of waveguide.

It is to be noted that as the abovedescribed receive operations take place, the circularly-polarized signals as received by the antenna are blocked from transmit portions 5, 7 and 9 of the diplexer apparatus 1. As previously discussed, this blocking is accomplished by the appropriate selection of diameters for these components which serve to cut off the lower frequency received signals while allowing the passage of higher frequency transmitted signals. Thus, the only possible path for the circularly-polarized received signals is into the rectangular waveguide sections 20–23 via the associated low-pass filters 16–19. As previously mentioned these filters act as matched impedances to the circularly-polarized received signals while acting as short circuits to transmitted signals. Details of the low-pass filters are described in the aforementioned U.S. Pat. No. 3,731,235 to DiTullio et al.

While there has been described what is considered to be the preferred embodiment of the invention, it will be obvious to those skilled in the art that various changes and modifications may be made therein without departing from the invention as called for in the appended claims.

What is claimed is:

1. Diplexer apparatus comprising:

first transducer means having first and second input ports and an output port, said first transducer means being operative to receive first and second signals within a first frequency bandwidth at the first and second input ports, respectively, and to establish said signals at the output port thereof to be orthogonal and linearly-polarized with respect to each other;

first polarizer means coupled to the first transducer means and operative to transform the orthogonal linearly-polarized signals at the output port of the first transducer means to orthogonal circularly-polarized signals;

electromagnetic wave conducting means having a first port coupled to the first polarizer means and a second port, said electromagnetic wave conducting means being operative to pass the circularly-polarized signals from the first polarizer means to the second port thereof, said electromagnetic wave conducting means further having third, fourth, fifth and sixth ports and being further operative to receive first and second circularly-polarized signals within a second frequency bandwidth at the second port thereof and to couple orthogonal vectoral components of said circularly-polarized signals to the third, fourth, fifth and sixth ports thereof;

first, second, third and fourth sections of waveguide respectively coupled to the third, fourth, fifth and sixth ports of the electromagnetic wave conducting means, said first and third sections of waveguide being operative to pass therethrough vectoral components of the circularly-polarized signals at the third and fifth ports of the electromagnetic wave conducting means and said second and fourth sections of waveguide being operative to pass therethrough orthogonal vectoral components of the circularly-polarized signals at the fourth and sixth ports of the electromagnetic wave conducting means;

first combining means having first and second inputs coupled respectively to the first and third sections of waveguide and operative to combine at an output thereof the vectoral components in the first and third sections of waveguide derived from the first and second circularly-polarized signals;

second combining means having first and second inputs coupled respectively to the second and fourth sections of waveguide and operative to combine at an output thereof the vectoral components in the second and fourth sections of waveguide derived from the first and second circularly-polarized signals;

second and third polarizer means coupled respectively to the outputs of the first and second combining means and operative to introduce a predetermined phase shift differential between the vectoral components at the outputs of the first and second combining means, said second and third polarizer means respectively including first and second sections of rectangular waveguide each having a row of pins therein; and third combining means having first and second inputs coupled to the sections of waveguide of the second and third polarizer means, respectively, and operative in response to the vectoral components from the second and third polarizer means to establish at first and second outputs thereof first and second resultant orthogonal linearly-polarized signals each corresponding to a different one of the circularly-polarized signals.

2. Diplexer apparatus in accordance with claim 1 wherein the first transducer means includes:

a first orthogonal mode transducer having a circular section of waveguide and a pair of rectangular sections of waveguide coupled into the circular section of waveguide and having input openings corresponding to the first and second input ports, said input openings being orthogonally-related to each other.

3. Diplexer apparatus in accordance with claim 2 wherein:

the first polarizer means includes a section of waveguide coupled to the circular section of waveguide of the orthogonal mode transducer and having first and second rows of pins and a pair of ridges therein, the rows of pins lying within a first plane and the pair of ridges lying within a second plane orthogonal to the first plane.

4. Diplexer apparatus in accordance with claim 3 wherein:

the section of waveguide of the first polarizer means is a circular section of waveguide, said circular section of waveguide being physically positioned with respect to the orthogonal mode transducer of the first transducer means so that either one of the first and second planes is at an acute angle with respect to the plane of either one of the first and second rectangular sections of waveguide of the orthogonal mode transducer.

5. Diplexer apparatus in accordance with claim 4 wherein the electromagnetic wave conducting means comprises:

a second orthogonal mode transducer including a circular section of waveguide having an opening at one end thereof corresponding to the first port, an opening at the other end thereof corresponding to the second port, and first, second, third and fourth orthogonally-related rectangular openings in the wall thereof; and first, second, third and fourth filters coupled into the first, second, third and fourth orthogonally-related rectangular openings in the wall of the circular section of waveguide of the second orthogonal mode transducer, said filters being operative to block passage therethrough of vectoral components of signals within the first frequency bandwidth and to permit passage therethrough of vectoral components of signals within the second frequency bandwidth.

6. Diplexer apparatus in accordance with claim 5 wherein:

the first section of rectangular waveguide of the second polarizer means has a pair of opposing rows of pins therein; and the second section of rectangular waveguide of the third polarizer means has only a single row of pins therein.

7. Diplexer apparatus in accordance with claim 6 wherein:

the pins of the opposing rows of pins in the first section of rectangular waveguide have heights varying along the lengths of the rows and the pins of the single row of pins in the second section of rectangular waveguide have heights varying along the length of the row.

8. Diplexer apparatus in accordance with claim 7 wherein each each of the first, second and third combining means includes a magic tee hybrid device.

9. Diplexer apparatus in accordance with claim 1 wherein:

the first polarizer means includes a section of waveguide coupled to the output port of the first transducer means and having first and second rows of pins and a pair of ridges therein, the rows of pins lying within a first plane and the pair of ridges lying within a second plane orthogonal to the first plane.

10. Diplexer apparatus in accordance with claim 9 wherein:

the first section of rectangular waveguide of the second polarizer means has a pair of opposing rows of pins therein; and the second section of rectangular waveguide of the third polarizer means has only a single row of pins therein.

11. Diplexer apparatus in accordance with claim 10 wherein:

the pins of the opposing rows of pins in the first section of rectangular waveguide have heights varying along the lengths of the rows, and the pins of the single row of pins in the second section of rectangular waveguide have heights varying along the length of the row.

12. Diplexer apparatus in accordance with claim 11 wherein each of the first, second and third combining means includes a magic tee hybrid device.

* * * * *